US005118939A

United States Patent [19]

Ishihara

[11] Patent Number: 5,118,939

[45] Date of Patent: Jun. 2, 1992

[54] SIMULTANEOUS DETECTION TYPE MASS SPECTROMETER

[75] Inventor: Morio Ishihara, Tokyo, Japan

[73] Assignee: Jeol Ltd., Tokyo, Japan

[21] Appl. No.: 708,073

[22] Filed: May 23, 1991

Related U.S. Application Data

[63] Continuation of Ser. No. 523,588, May 15, 1990, abandoned.

[30] Foreign Application Priority Data

May 19, 1989 [JP] Japan ..... 1-125959

[51] Int. Cl.[5] ..... H01J 49/32

[52] U.S. Cl. ..... 250/299; 250/300; 250/296

[58] Field of Search ..... 250/299, 298, 296, 292, 250/396 ML, 396 R, 300

[56] References Cited

U.S. PATENT DOCUMENTS 4,174,479 11/1979 Tuithof et al. ..... 250/299
4,435,642 3/1984 Neugebauer et al. ..... 250/296
4,472,631 9/1984 Enke et al. ..... 250/281
4,638,160 1/1987 Slodzian et al. ..... 250/296
4,924,090 5/1990 Wollnik et al. ..... 250/299
4,998,015 3/1991 Ishihara ..... 250/298

FOREIGN PATENT DOCUMENTS 8912315 12/1989 World Int. Prop. O. ..... 250/296

OTHER PUBLICATIONS

Lyubchik et al., Sov. Phys. Tech. Phys., vol. 19, No. 11, May 1975, pp. 1403-1407.

*Primary Examiner*—Jack I. Berman
*Attorney, Agent, or Firm*—Webb, Burden, Ziesenheim & Webb

[57] ABSTRACT

A magnetic mass spectrometer having a one or two-dimensional ion detector for simultaneously detecting all ions focused and separated by the magnetic field. An electrostatic or magnetic octupole lens producing an octupole field is disposed in the ion path between the magnetic field and the detector.

1 Claim, 3 Drawing Sheets

SIMULTANEOUS DETECTION TYPE MASS SPECTROMETER

This is a continuation of copending application Ser. No. 07/523,588, filed May 15, 1990 now abandoned.

FIELD OF THE INVENTION

The present invention relates to a mass spectrometer and, more particularly, to a magnetic sector type mass spectrometer equipped with a two-dimensional ion detector for simultaneously detecting ions having different masses.

BACKGROUND OF THE INVENTION

Magnetic vector type spectrometers having a mass-dispersive magnetic field are broadly classified into two major categories: the magnetic scanning type using a single ion detector and providing a mass spectrum by scanning the magnetic field; and the simultaneous detection type which uses a one or two-dimensional ion detector, such as an array detector, having spatial resolution and simultaneously detects analyte ions dispersed according to mass to charge ratio by the magnetic field.

Many of the mass spectrometers developed heretofore are scanning type mass spectrometers. The simultaneous detection type is theoretically superior in sensitivity to the scanning type because the former type detects all analyte ions simultaneously, while the latter type discards ions other than ions reaching the ion detector. However, one or two-dimensional ion detectors presently available are only photographic plates having low sensitivity and, therefore, simultaneous detection type mass spectrometers have not been widely accepted into general use.

As the resolution and the sensitivity of one or two-dimensional ion detectors have been improved by the introduction of advanced semiconductor fabrication techniques, the simultaneous detection type mass spectrometer which has excellent characteristics in principle has attracted attention in these years. In recent years, simultaneous detection has been attempted by combining various mass spectrometers with one or two-dimensional ion detectors. Such mass spectrometers are disclosed, for example, in the U.S. Pat. Nos. 4,435,642, 4,472,631, and 4,638,160.

Normally, a one or two-dimensional ion detector detects ions existing in a plane, which is hereinafter referred to as the "detection plane". On the other hand, in a simultaneous detection type mass spectrometer, analyte ions are dispersed according to mass toward a focal plane. This focal plane is a curved plane except where the ion optical system is a special ion optical system such as the Mattauch-Herzog geometry. FIG. 4 shows the relation among a mass analyzer 1 having a magnetic field, a one or two-dimensional ion detector 2, and a focal plane 3. As can be seen from this figure, the focal plane 3 is coincident with the detection plane 4 of the detector for ions of mass $m_2$, and these ions are sharply focused onto one of the detecting elements constituting the two-dimensional detector. However, both planes do not agree for other ions of different masses such as masses $m_1$ and $m_3$. Ions of masses $m_1$ and $m_3$ impinge on the detection plane in defocused condition. In this geometry, the resolution deteriorates at the ends of the detector 2. For this reason, only a narrow central region of the spectrum can be observed. It is inevitable, therefore, that the measured mass range is narrow.

SUMMARY OF THE INVENTION

In view of the foregoing, it is an object of the present invention to provide a magnetic mass spectrometer which uses a one or two-dimensional ion detector and is capable of simultaneously detecting ions in an extended mass range.

The above object is achieved by a magnetic mass spectrometer comprising a magnetic field for focusing and separating analyte ions according to mass to charge ratio, a one or two-dimensional ion detector disposed along a focal plane for simultaneously detecting the ions, and electrostatic or magnetic lenses disposed in the ion path between the magnetic field and the detector for producing an electrostatic or magnetic multipole field having an even number of at least eight poles of alternating signs.

DETAILED DESCRIPTION OF THE INVENTION

Figure 5:
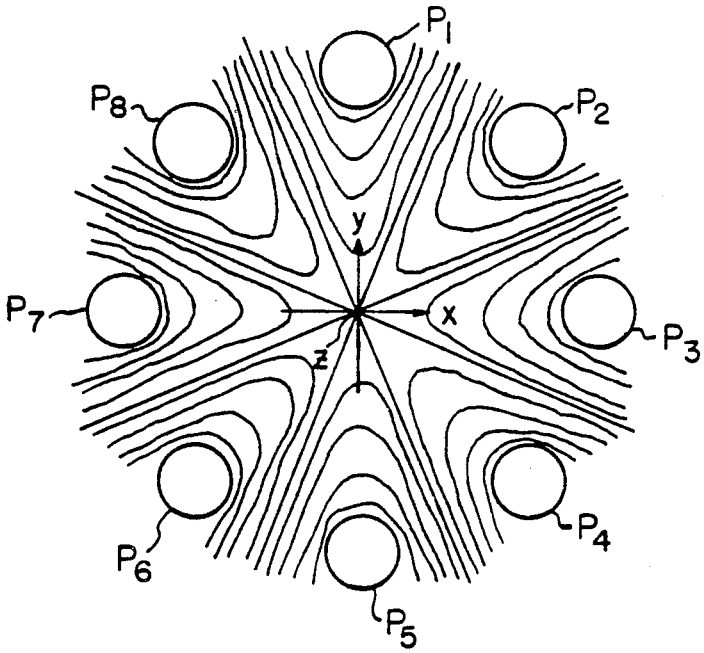
FIG. 5 is a diagram showing an electrostatic octupole field produced inside an electrostatic octupole lens, as well as x-y-z coordinate system.

We first discuss an electrostatic octupole field by referring to FIG. 5. This field is produced inside an electrostatic octupole lens L consisting of eight electrodes $P_1$–$P_8$ of alternating polarity. These electrodes are equidistant from the optical axis Z, extend parallel to the axis Z, and are arranged around the axis Z.

In this octupole field, the potential $V_8$ (x, y) at an arbitrary point (x, y) on the x-y plane vertical to the optical axis is given by $$V_8(x, y)=g\,(x^4-6x^2y^2+y^4) \tag{1}$$

where g is a coefficient proportional to the potential applied to the electrodes.

The orbital plane given by y=0 is treated in mass spectrometry. Therefore, in this orbital plane (y=0), the potential is given by $$V_8(x)=gx^4 \tag{2}$$

Inside the orbital plane given by equation (2), each charged particle undergoes a force F(x) from the octupole field, the force being given by $$F(x)=-e\,(dV_8(x)\,/\,dx)=-4gex^3 \tag{3}$$

where e is the electric charge of the particle. We now consider the effect of the lens upon an ion beam about $x=0$. This effect is in proportion to the rate of change of the force F(x) with respect to position. Accordingly, the effect of the lens about $x=x_0$ is given by $$dF(x)/dx|_{x=x0}=-12gex_0^2 \quad (4)$$

Figure 6A:
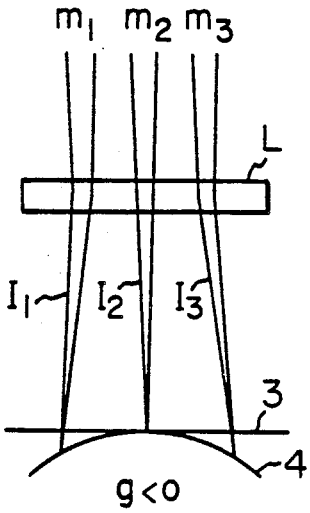
FIGS. 6(*a*), 6(*b*), and 6(*c*) are diagrams in which the effects of the octupole lens L shown in FIG. 2 are plotted against a coefficient g, the effects being represented by equation (4)
Figure 6B:
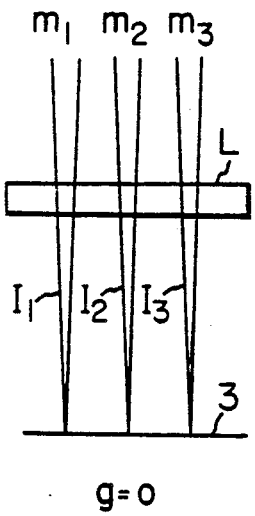
Figure 6C:
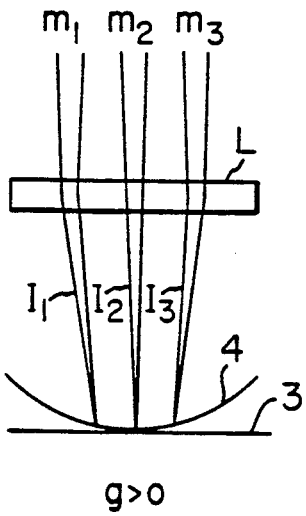

It can be seen from equation (4) that the effect of the lens is proportional to squares of the distance from the center axis. FIGS. 6(*a*) and 6(*c*) show the effect of an octupole lens L when the distortion of the focal plane originally does not exist and the three ion beams $I_1$–$I_3$ are focused onto the flat detection plane 3, as shown in FIG. 6(*b*). In FIGS. 6(*a*), 6(*b*), and 6(*c*), the effect of the lens given by equation (4) is plotted against the coefficient g. FIG. 6(*b*) shows the condition in which $g=0$, i.e., the lens is substantially absent. In this condition shown in FIG. 6(*b*), three ion beams $I_1$, $I_2$ and $I_3$ are focused onto the detection plane 3. FIG. 6(*a*) shows the condition in which $g<0$. In this condition, the three ion beams $I_1$, $I_2$ and $I_3$ are focused onto a quadratic curve or plane 4 by the octupole lens L. FIG. 6(*c*) shows the condition in which $g>0$. In this condition, the three ion beams $I_1$, $I_2$ and $I_3$ are focused onto a quadratic curve or plane 4 by the octupole lens L.

Figure 7A:
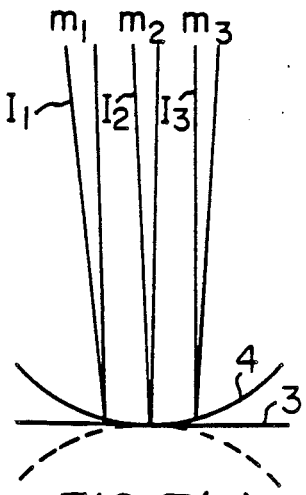
FIGS. 7(*a*) and 7(*b*) are diagrams illustrating compensation made by the electrostatic octupole lens shown in FIG. 2.
Figure 7B:
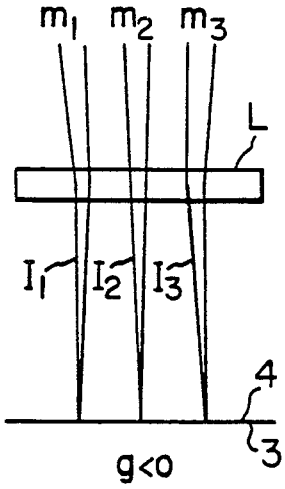

FIG. 7(*b*) shows the effect of an octupole lens L when the distortion of the focal plane originally exists, as shown in FIG. 7(*a*). In the condition shown in FIG. 7(*a*), no electrostatic octupole lens is placed, and the ion beams are focused onto a quadratic curve 4 in the same way as in the condition shown in FIG. 6(*c*). Then, an electrostatic octupole lens L is placed as shown in FIG. 7(*b*). The lens is energized under the condition $g<0$ so as to act as shown in FIG. 6(*a*). As a result, the orbits of the three ion beams are so corrected that the beams are focused onto the detection plane 3.

Similarly, for an electrostatic lens having 10 poles of alternating sign and an electrostatic lens having 12 poles of alternating sign, the potentials $V_{10}(x, y)$ and $V_{12}(x, y)$ at an arbitrary point (x, y) on the x-y plane perpendicular to the optical axis are given by $$V_{10}(x, y)=g(x^5-10x^3y^2+5xy^4) \quad (1')$$

$$V_{12}(x, y)=g(x^6-5x^4y^2+15x^2y^4-y^6) \quad (1'')$$

Therefore, in the orbital plane $y=0$, the potentials are given by $$V_{10}(x)=gx^5 \quad (2')$$

$$V_{12}(x)=gx^6 \quad (2'')$$

Charged particles undergo forces $F_{10}(x)$ and $F_{12}(x)$ from the fields having the ten poles and the twelve poles, respectively, in the orbital planes given by equations (2') and (2''), respectively. These forces are given by $$F_{10}(x)=-e\,(dV_{10}(x)/dz)=-5gex^4 \quad (3')$$

$$F_{12}(x)=-e\,(dV_{12}(x)/dx)=-6gex^5 \quad (3'')$$

Therefore, the effects of the lenses around $x=x_0$ are given by $$dF_{10}(x)/dx|_{x=x0}=-20gex_0^3 \quad (4')$$

$$dF_{12}(x)/dx|_{x-x0}=-30gex_0^4 \quad (4'')$$

It can be seen from equation (4') that the effect of the electrostatic lens having the 10 poles is in proportion to the cube of the distance from the center axis. If the distortion of the focal plane is represented by a cubic equation, the distortion can be corrected, using the electrostatic lens having 10 poles of alternating polarity arranged in a circle.

It can be seen from equation (4'') that the effect of the electrostatic lens having the 12 poles is in proportion to the fourth power of the distance from the center axis. If the distortion of the focal plane is represented by a quartic function, the distortion can be corrected, using the lens having the 12 poles.

The present invention can be similarly applied to a magnetic multipole field produced by a magnetic lens. A similar correction may be made by a magnetic multipole lens.

Figure 1:
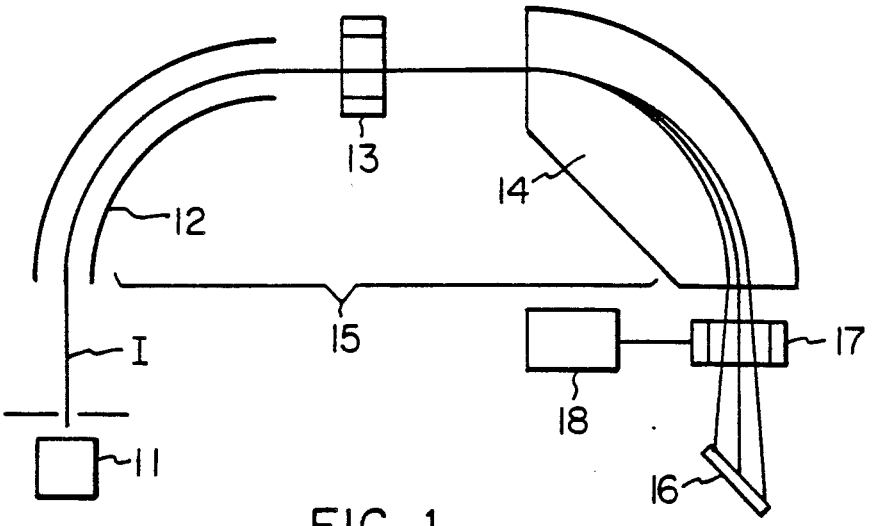
FIG. 1 is a schematic diagram of a mass spectrometer according to the invention.

Referring next to FIG. 1, there is shown a mass spectrometer embodying the concept of the present invention. This spectrometer comprises an ion source 11 emitting analyte ions I, a double-focusing mass analyzer 15, an electrostatic octupole lens 17 for producing a magnetic octupole field, an array ion detector 16, and a lens power supply 18 connected with the lens 17.

The mass analyzer 15 consists of a cylindrical electric field 12, an electrostatic quadrupole lens 13, and a sector magnetic field 14 as disclosed in Japanese Patent Publication No. 31261/1982. The ions I emitted by the ion source are introduced into the mass analyzer 15 and dispersed according to mass to form a mass spectrum. The detector 16 is disposed along a focal plane. The lens 17 is positioned in the ion path between the magnetic field 14 and the detector 16.

Figure 2:
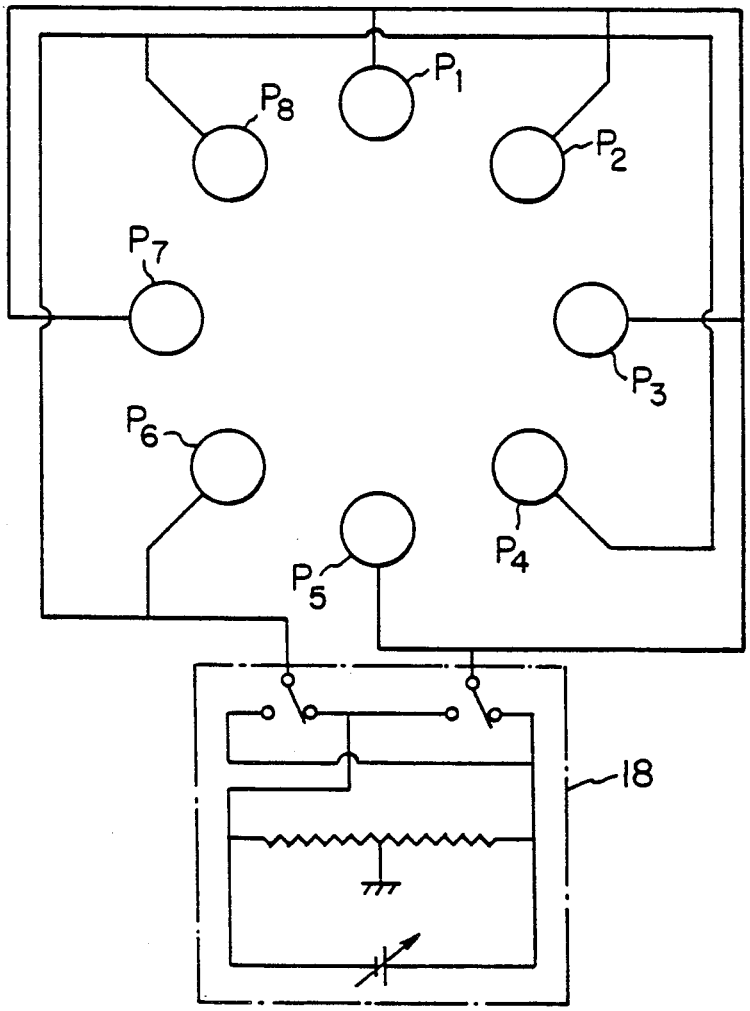
FIG. 2 is a cross-sectional view of an electrostatic octupole lens for use in a mass spectrometer according to the invention.

FIG. 2 is a cross section of the electrostatic octupole lens 17, taken at right angles to the ion path. The lens consists of 8 electrodes $P_1$–$P_8$ which are arranged in a circle and regularly spaced from each other in the same way as the geometry shown in FIG. 5. Voltages of +V and −V are alternately applied to each electrode from the power supply 18. The polarity of the output voltage from the power supply 18 can be inverted by selector switches 19. The absolute value of the amplitude of the output voltage can be varied.

In the operation of the apparatus described thus far, if the lens 17 does not exist, the focal plane may be distorted as shown in FIG. 7(*a*). This distortion is canceled out as shown in FIG. 7(*b*) by adjusting the power supply 18 so as to appropriately set the coefficient g of the magnetic octupole field set up by the electrostatic octupole lens 17. Thus, the focal plane can be made coincident with the detection plane of the array detector. Even the ion beams arriving at the ends of the detector are correctly focused. Consequently, the detected range of the mass spectrum can be extended greatly.

If the distortion of the focal plane is of the opposite polarity as indicated by the broken line in FIG. 7(*a*), then the polarity of the lens 17 is inverted. The intensity is appropriately adjusted. Thus, the focal plane can be brought into agreement with the detection plane of the ion detector in the same way as the foregoing.

Figure 3:
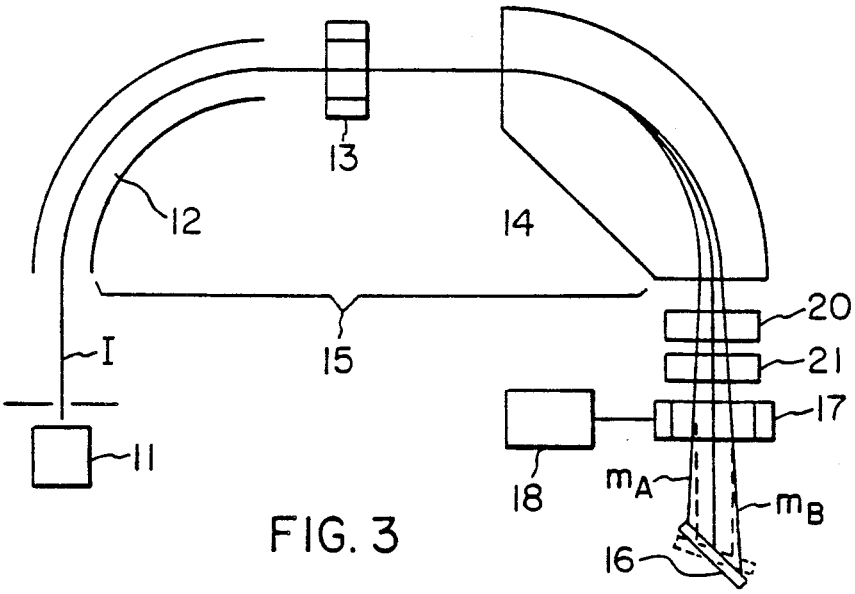
FIG. 3 is a schematic diagram of another mass spectrometer according to the invention.
Figure 4:
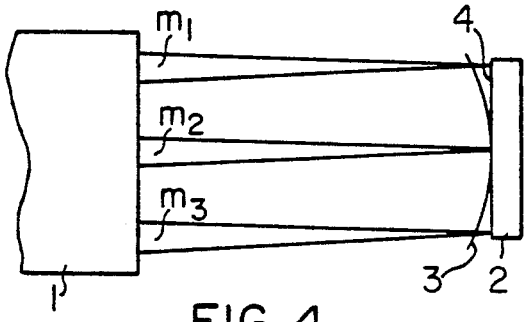
FIG. 4 is a diagram illustrating the relation among a mass analyzer including a magnetic field, a two-dimensional ion detector, and a focal plane.

Referring next to FIG. 3, there is shown another mass spectrometer which is similar to the mass spectrometer already described in connection with FIGS. 1 and 2 except that two quadrupole lenses 20 and 21 are inserted between the sector magnetic field 14 and the array ion detector 16 and that the detector 16 is mounted rotatably. A mass spectrometer of this kind has been already proposed in U.S. Patent application Ser. No. 07/379,561 now U.S. Pat. No. 4,998,015. In this instrument, the degree of mass dispersion in the ion optical system is varied by the quadrupole lenses to change the mass range of ions dispersed in the focal plane of the one or two-dimensional ion detector. That is, the observed range of the mass spectrum can be either extended or contracted.

In the operation of the instrument shown in FIG. 3, when the degree of mass dispersion in the ion optical system is varied by varying the amplitude of the quadrupole lenses, ions lying in the mass range (indicated by the solid lines) from mass $m_A$ to mass $m_B$ are restricted to a narrower range indicated by the broken lines. As a result, the range of the ion masses dispersed in the detection plane of the two-dimensional ion detector 16 is extended. Since the tilt of the focal plane varies at the same time, the detector 16 is rotated in step with the tilt of the focal plane. Also, the curvature of the focal plane varies. Therefore, the power supply 18 is adjusted to correct the coefficient g of the magnetic octupole field produced by the electrostatic octupole lens 17. Thus, the focal plane is maintained coincident with the detection plane of the ion detector 16 if the mass range is varied.

The coefficient g can be manually set by the operator. Alternatively, a function describing the relation of the powers of the quadrupole lenses or the degree of mass dispersion to optimum values of the coefficient g is previously found. The relation can also take the form of a table. Then, the power supply 18 is operated according to the function or the table to set the optimum value of the coefficient g. The operation that the operator must perform can be made easier by providing a control unit which stores the function or the table in a memory, reads the coefficient g or the output voltage from the power supply 18 best suited for the powers of the quadrupole lenses from the memory, controls the power supply 18 according to the obtained value, and sets the optimum value of the coefficient g.

In the above examples, electrostatic quadrupole lenses are used. If electrostatic lenses having 10 or 12 poles of alternating polarity are employed, the third- or the fourth-order compensation can be made in the same manner. If magnetic lenses having 8, 10, or 12 poles of alternating polarity are used, the second-, the third- or the fourth-order compensation can similarly be made. This lens producing a magnetic multipole field is required to be disposed behind the magnetic field so that the lens acts on the analyte ions after they are mass-analyzed by the magnetic field.

Still higher order compensation may be made by designing the instrument in such a way that the angle between the multipole field-producing lens and the ion beam path can be varied.

In the above examples, the detection plane of the two-dimensional detector is a flat plane with which the focal plane is made to agree. The invention is also applicable to a mass spectrometer in which the detection plane is a curved plane, and in which the compensation is made so that the focal plane may agree with this curved plane.

Furthermore, the invention can be applied to every kind of simultaneous detection type mass spectrometer having a magnetic field, including both single-focusing type and double-focusing type. The invention can be applied to a double-focusing mass spectrometer in which the electric field is placed after the magnetic field. In these cases, it is necessary to place the multipole lens behind the magnetic field as described previously.

As described in detail thus far, in the novel magnetic mass spectrometer, analyte ions are separated according to mass by the magnetic field and then detected simultaneously by a one or two-dimensional ion detector that is disposed along a focal plane. This spectrometer is characterized in that an electrostatic or magnetic multipole lens for producing a multipole field having at least eight poles is disposed in the ion path between the magnetic field and the detector. Hence, a compensation can be made to make the focal plane coincident with the detection plane of the detector. Consequently, the measured mass range of the spectrometer can be extended compared with the mass range of the prior art instrument.

Having thus described my invention with the detail and particularly required by the Patent Laws, what is claimed and desired to be protected by Letters Patent is set forth in the following claims; what is claimed is:

1. A simultaneous detection type double-focusing mass spectrometer comprising:

a cylindrical electrical field and a sector magnetic field for focusing and separating analyte ions according to mass;

a one or two-dimensional ion detector disposed along a detection plane;

means for rotating the ion detector;

a means for varying the degree of mass dispersion comprising two quadrupole lenses which are arranged between the magnetic field and the ion detector;

an electrostatic or magnetic lens disposed in the ion path between the magnetic field and the detector and producing an electrostatic or magnetic multipole field having an even number of at least eight poles of alternating polarity for adjusting the curvature of focal plane of the dispersed analyte ions; and means for varying the power of the electrostatic or magnetic lens producing the multipole field according to the degree of mass dispersion set by the mass dispersion-varying means and rotating the ion detector such that the focal plane is maintained coincident with the detection plane.

* * * * *

UNITED STATES PATENT AND TRADEMARK OFFICE

CERTIFICATE OF CORRECTION

PATENT NO. : 5,118,939

DATED : June 2, 1992

INVENTOR(S) : Morio Ishihara

It is certified that error appears in the above-identified patent and that said Letters Patent is hereby corrected as shown below:

Title page, after [73] Assignee: "Jeol" should read --JEOL--.

Column 1 Line 16 "vector" should read --, sector--.

Column 3 Line 44 "$5x^4y^2$" should read --$15x^4y^2$--.

Column 3 Line 57 "dz" should read --dx--.

Column 3 Line 65 "x-x0" should read --x=x0--.

Column 4 Line 66 "application" should read --Application--.

Signed and Sealed this

Seventeenth Day of August, 1993

Bruce Lehman

*Attest:*

BRUCE LEHMAN

*Attesting Officer*

*Commissioner of Patents and Trademarks*